US010982164B2

(12) United States Patent
Molburg

(10) Patent No.: US 10,982,164 B2
(45) Date of Patent: Apr. 20, 2021

(54) DEVICE FOR STARTING AND MAINTAINING A CAMPFIRE

(71) Applicant: John C. Molburg, Valparaiso, IN (US)

(72) Inventor: John C. Molburg, Valparaiso, IN (US)

( * ) Notice: Subject to any disclaimer, the term of this patent is extended or adjusted under 35 U.S.C. 154(b) by 294 days.

(21) Appl. No.: 15/795,808

(22) Filed: Oct. 27, 2017

(65) Prior Publication Data

US 2018/0119042 A1 May 3, 2018

Related U.S. Application Data

(60) Provisional application No. 62/496,937, filed on Nov. 2, 2016.

(51) Int. Cl.
*C10L 11/04* (2006.01)
*C10L 11/06* (2006.01)

(52) U.S. Cl.
CPC ..... *C10L 11/04* (2013.01); *C10L 11/06* (2013.01)

(58) Field of Classification Search
CPC ..... C10L 11/04; C10L 11/06; C10L 2230/06; C10L 5/365; C10L 5/368; C10L 2200/0469
See application file for complete search history.

(56) References Cited

U.S. PATENT DOCUMENTS 9,532,679 B1 * 1/2017 Besch ..... A47J 33/00
2009/0159073 A1 * 6/2009 Giordano ..... C10L 5/368 126/500
2013/0318864 A1 * 12/2013 Schroeder ..... C10L 5/368 44/511

FOREIGN PATENT DOCUMENTS

WO WO-2014083452 A1 * 6/2014 ..... C10L 11/06

* cited by examiner

*Primary Examiner* — Ellen M McAvoy
*Assistant Examiner* — Ming Cheung Po
(74) *Attorney, Agent, or Firm* — Donald G. Flaynik

(57) ABSTRACT

A device for starting and maintaining a campfire includes an inner combustible structure formed from a plurality of inner combustible members having bottom end portions separated and secured to a top planar wall of a combustible lower support member. The device further includes an outer combustible structure formed from a plurality of outer combustible members having bottom end portions separated and secured to edge portions of the combustible lower support member. A fire accelerant is disposed in an inner portion of the inner combustible structure to promote a faster starting campfire.

17 Claims, 15 Drawing Sheets

DEVICE FOR STARTING AND MAINTAINING A CAMPFIRE

This Utility Patent Application is based on Provisional Patent Application No. 62/496,937 filed on Nov. 2, 2016.

BACKGROUND OF THE INVENTION

1. Field of the Invention

The present invention relates to a device for starting and maintaining a campfire, and more particularly, to a device that uses two different wood configurations: an inner first configuration that promotes a relatively fast start for a campfire, and a second outer configuration that promotes a relatively longer time frame for the campfire to burn.

2. Background of the Prior Art

Outdoor camping enthusiasts enjoy starting a campfire at campsite at all times of day and night. Typically, campers start a campfire by bringing firewood to or finding firewood at a campsite, then piling the firewood over paper or similar accelerant and lighting the accelerant. Alternatively, firewood having predetermined lengths is positioned to form a "teepee" configuration upon an accelerant, then igniting the accelerant to ignite the teepee configuration. Irrespective of the firewood configuration, the time to assemble the firewood and start the campfire is generally "too long," and the time the campfire lasts before new firewood must be added is "too short."

To make outdoor camping more enjoyable, a camper needs a firewood structure that requires no assembly and that can be carried by one person; that includes a first type of firewood that relatively quickly ignites; that includes a second type of firewood that burns for a relatively long time period; and that allows an accelerant such as paper to be disposed inside the firewood structure before or after a campsite is selected.

SUMMARY OF THE INVENTION

It is an object of the present invention to overcome many of the disadvantages associated with prior art firewood configurations and/or structures to start and maintain a campfire. A principal object of the present invention is to assemble and configure firewood such that a campfire can be started relatively quickly and maintained for a relatively longer time period of time than prior art firewood assemblies. A feature of the present invention is to combine an inner wood assembly or structure that is substantially encased by an outer wood assembly or structure. Another feature of the present invention is to secure the inner and outer structures together to form a device that a user can carry in one hand. An advantage of the present invention or device is that all campfire wood is preassemble so that a user need only set the device on the ground then ignite the inner wood structure. Another advantage of the present invention or device is that an accelerant can be disposed inside the periphery of the inner wood structure.

Another object of the present invention is to provide a firewood structure that can be ignited relatively quickly. A feature of the firewood structure is an inner wood structure having relatively small, fast burning inner combustible wood members. Another feature is the use of an accelerant such as paper disposed inside the periphery of the inner wood structure. An advantage of the firewood structure is that the inner wood structure ignites relatively quickly, which in turn ignites an outer wood structure relatively quickly.

Another object of the present invention is to provide a firewood structure that burns for a relatively time period before more firewood has to be added to the campfire. A feature of the firewood structure is an outer wood structure having relatively large, slow burning outer combustible wood members. An Advantage of the firewood structure is that the outer wood structure is sized and configured to encase the smaller inner wood structure, thereby promoting cooperation between the inner and outer wood structures to achieve a relatively fast campfire start and a relatively long campfire burn before adding more firewood.

Briefly, the invention provides a device or structure for starting and maintaining a campfire, the device includes:

an inner combustible structure having a relatively frusto-conical configuration formed from a plurality of inner combustible members having bottom end portions distally separated from adjacent bottom end portions of adjacent inner combustible members. The bottom end portions of the inner combustible members are secured to respective inner portions of a lower support member such that outer bottom end portions of the inner combustible members are substantially equidistant from a center point of the lower support member. The plurality of inner combustible members have top end portions secured together such that a relatively frusto-conically configured top portion is formed for the relatively frusto-conically configured inner combustible structure; and an outer combustible structure substantially encasing the inner combustible structure. The outer combustible structure has a relatively frusto-conical configuration formed from a plurality of outer combustible members having bottom end portions distally separated from adjacent bottom end portions of adjacent outer combustible members. The bottom end portions of the outer combustible members are secured to respective outer portions of the lower support member such that outer bottom end portions of the outer combustible members are substantially equidistant from the center point of the lower support member. The plurality of outer combustible members have top end portions secured together such that a relatively frusto-conically configured top portion is formed for the relatively frusto-conically configured outer combustible structure. The inner and outer combustible structures cooperate such that the inner combustible structure promotes the starting of a fire and the outer combustible structure maintains the fire for a predetermined time range.

The invention further provides a structure for starting a campfire that includes:

a central combustible structure having a relatively frusto-conical configuration formed from a plurality of central combustible members having bottom end walls distally separated from adjacent bottom end portions of adjacent central combustible members, the bottom end walls of the central combustible members being secured to respective inner portions of a lower support member such that the bottom end walls are substantially equidistant from a center point of the lower support member, the plurality of central combustible members initiating a campfire;

an inner combustible structure substantially encasing the central combustible structure, the inner combustible structure having a relatively frusto-conical configuration formed from a plurality of inner combustible members having bottom end portions distally separated from adjacent bottom end portions of adjacent inner combustible members, the bottom end portions of the inner combustible members being secured to respective inner portions of the lower support member such that outer bottom end portions of the inner combustible members are substantially equidistant from the center point of the lower support member, the plurality of inner combustible members having top end portions secured together such that a relatively frusto-conically configured top portion is formed for the relatively frusto-conically configured inner combustible structure, the inner combustible structure cooperating with the central combustible structure to start a campfire; and an outer combustible structure substantially encasing said inner combustible structure, the outer combustible structure having a relatively frusto-conical configuration formed from a plurality of outer combustible members having bottom end portions distally separated from adjacent bottom end portions of adjacent outer combustible members, the bottom end portions of the outer combustible members being secured to respective outer portions of the lower support member such that outer bottom end portions of the outer combustible members are substantially equidistant from the center point of the lower support member, the plurality of outer combustible members having top end portions secured together such that a relatively frusto-conically configured top portion is formed for the relatively frusto-conically configured outer combustible structure; whereby, the central, inner and outer combustible structures cooperate such that the central and inner combustible structures promote the starting of a fire, and the outer combustible structure maintains the fire for a predetermined time range.

The invention also provides a structure for starting a campfire with firewood having varying lengths that includes:

a plurality of inner combustible members of varying lengths disposed upon a ground surface such that top end portions of the inner combustible members are secured together, and bottom end portions of the inner combustible members are separated and engage cooperating ground portions; and a plurality of outer combustible members of varying lengths disposed about the plurality of inner combustible members. The outer combustible members are relatively longer than the inner combustible members, thereby enabling top end portions of the outer combustible members to be secured together and above secured together top end portions of the inner combustible members when bottom end portions of the outer combustible members engage cooperating ground portions about the bottom end portions of the inner combustible members. The inner combustible members promote the starting of a fire and the outer combustible members maintain the fire for a predetermined time range.

BRIEF DESCRIPTION OF THE DRAWINGS

The foregoing invention and its advantages may be readily appreciated from the following detailed description of the preferred embodiment, when read in conjunction with the accompanying drawings in which.

DESCRIPTION OF THE PREFERRED EMBODIMENT

Figure 1:
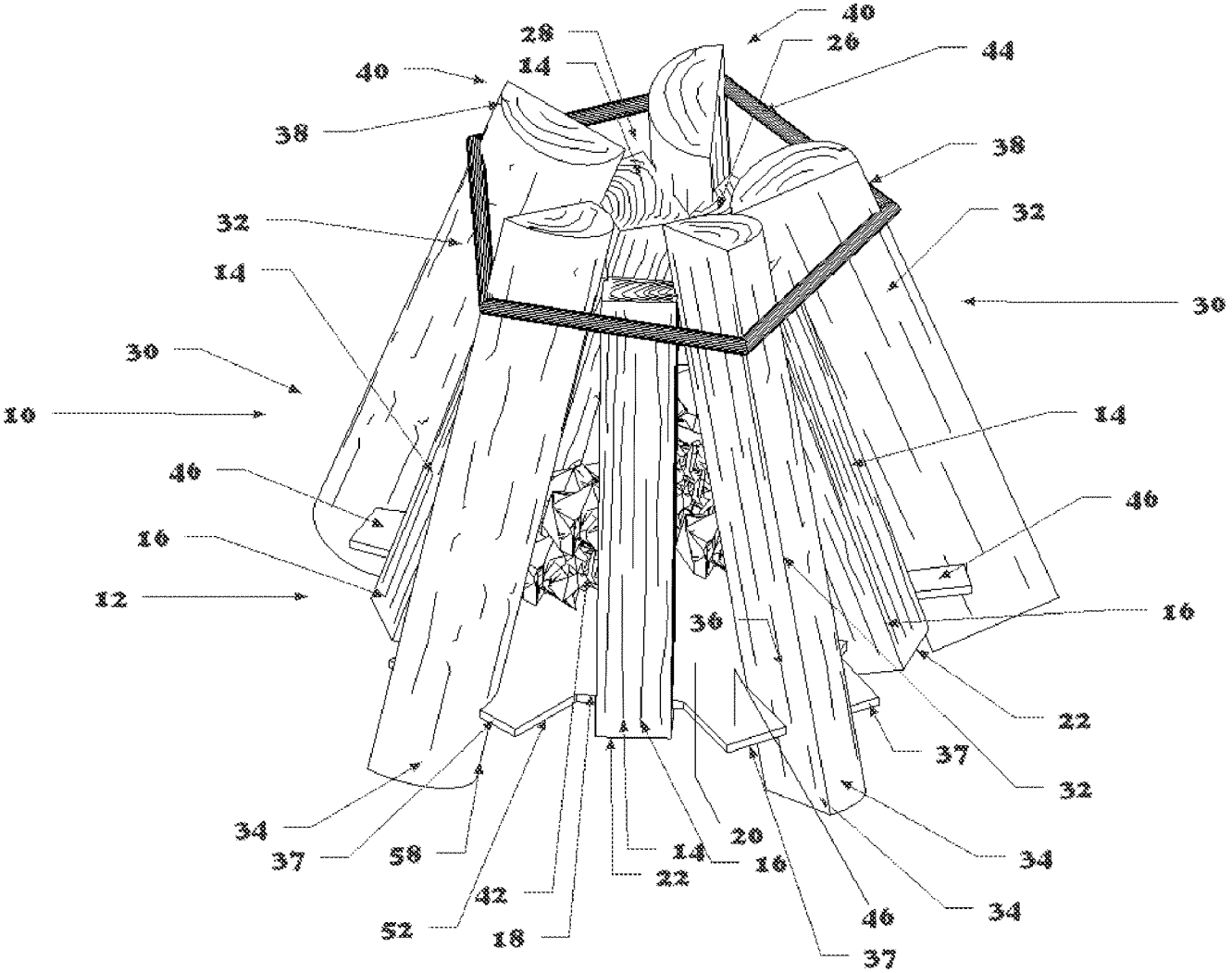
FIG. 1 is a front perspective view of a device for starting and maintaining a campfire in accordance with the present invention.
Figure 2:
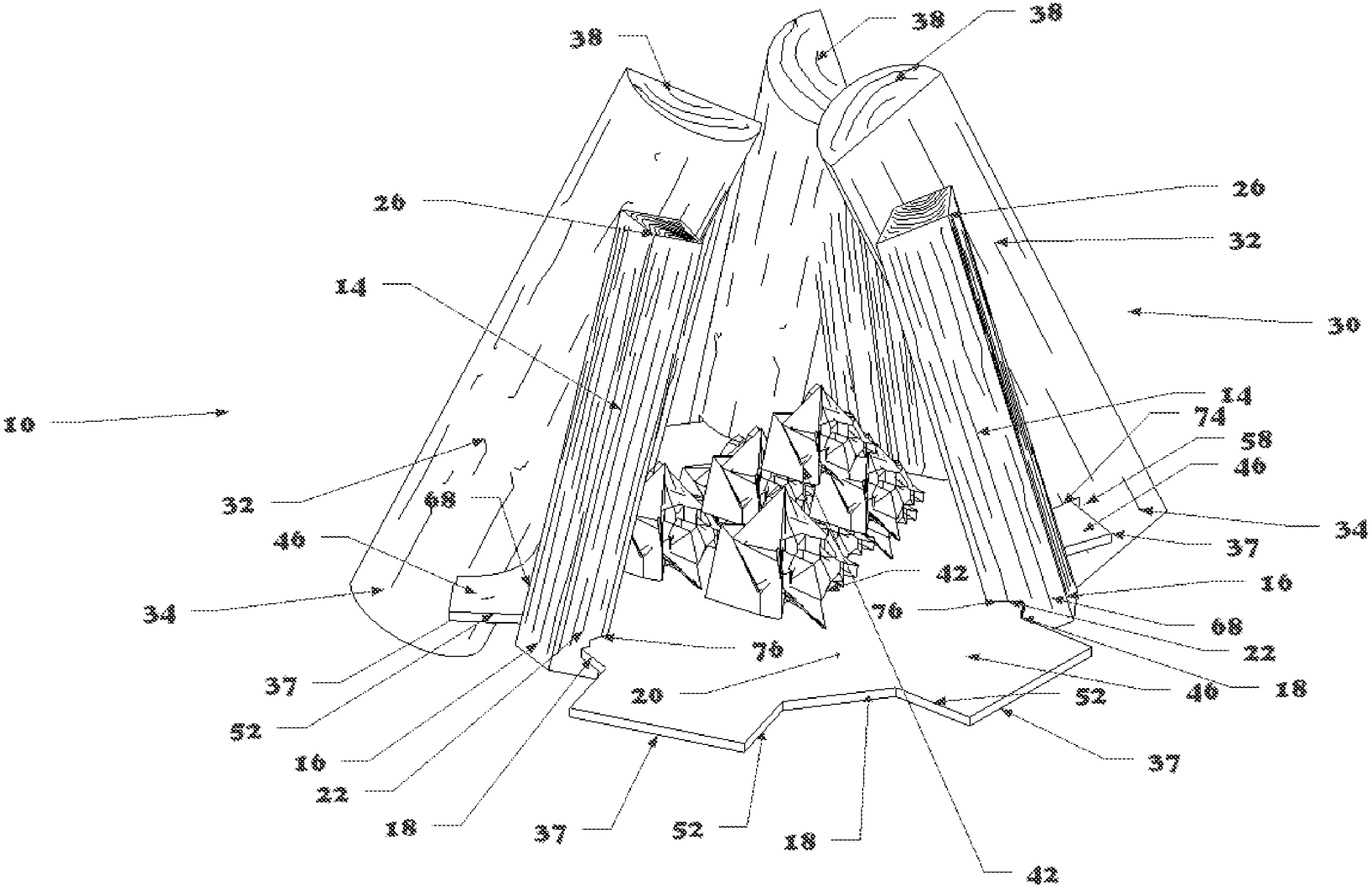
FIG. 2 is the front perspective view of the device of FIG. 1, but with two adjacent members of an outer combustible structure removed to better depict a smaller inner combustible structure and an inner paper fire accelerant.
Figure 3:
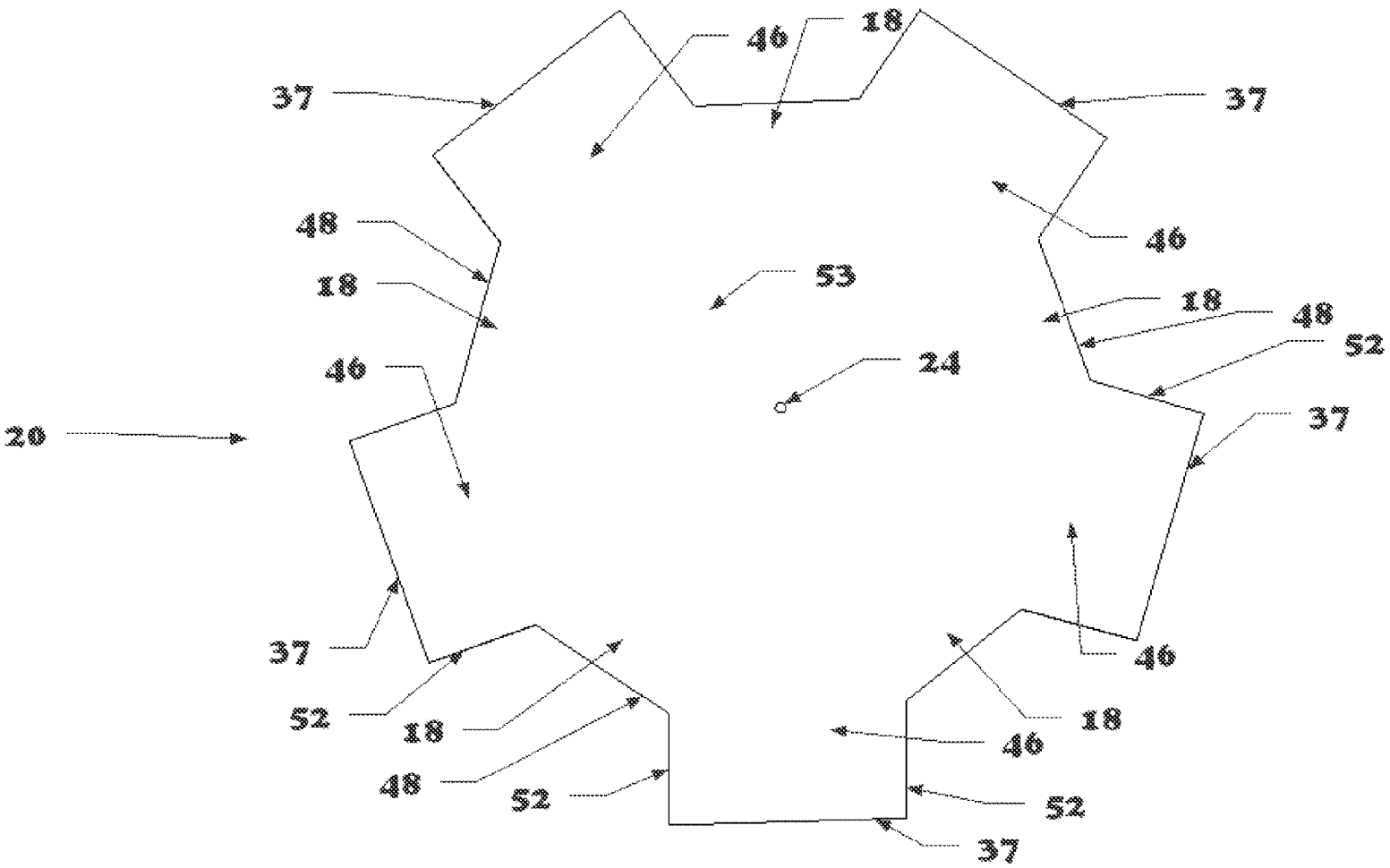
FIG. 3 is a top elevation view of a lower support member of the device of FIG. 1.
Figure 4:
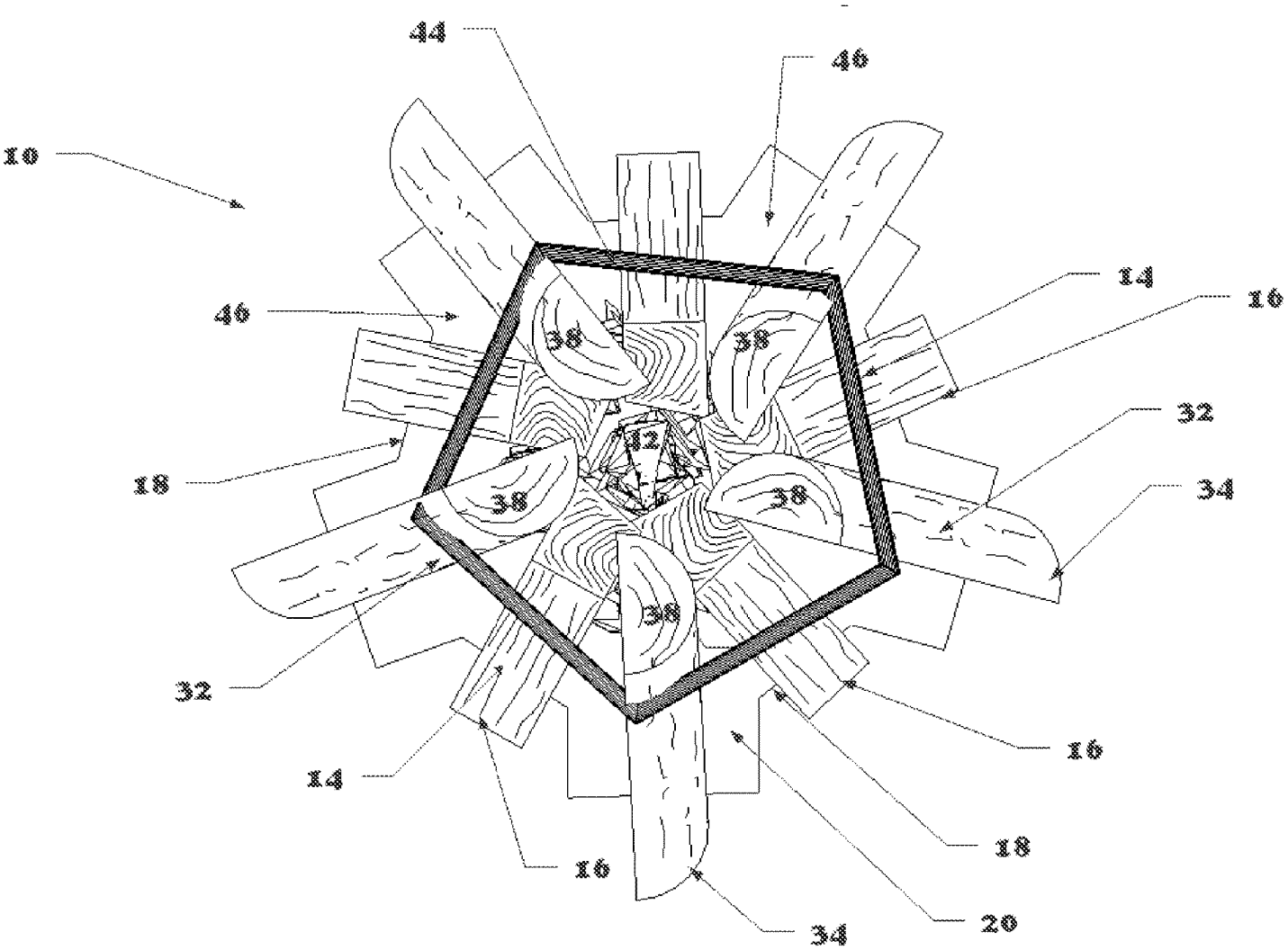
FIG. 4 is a top elevation view of the device of FIG. 1.
Figure 5:
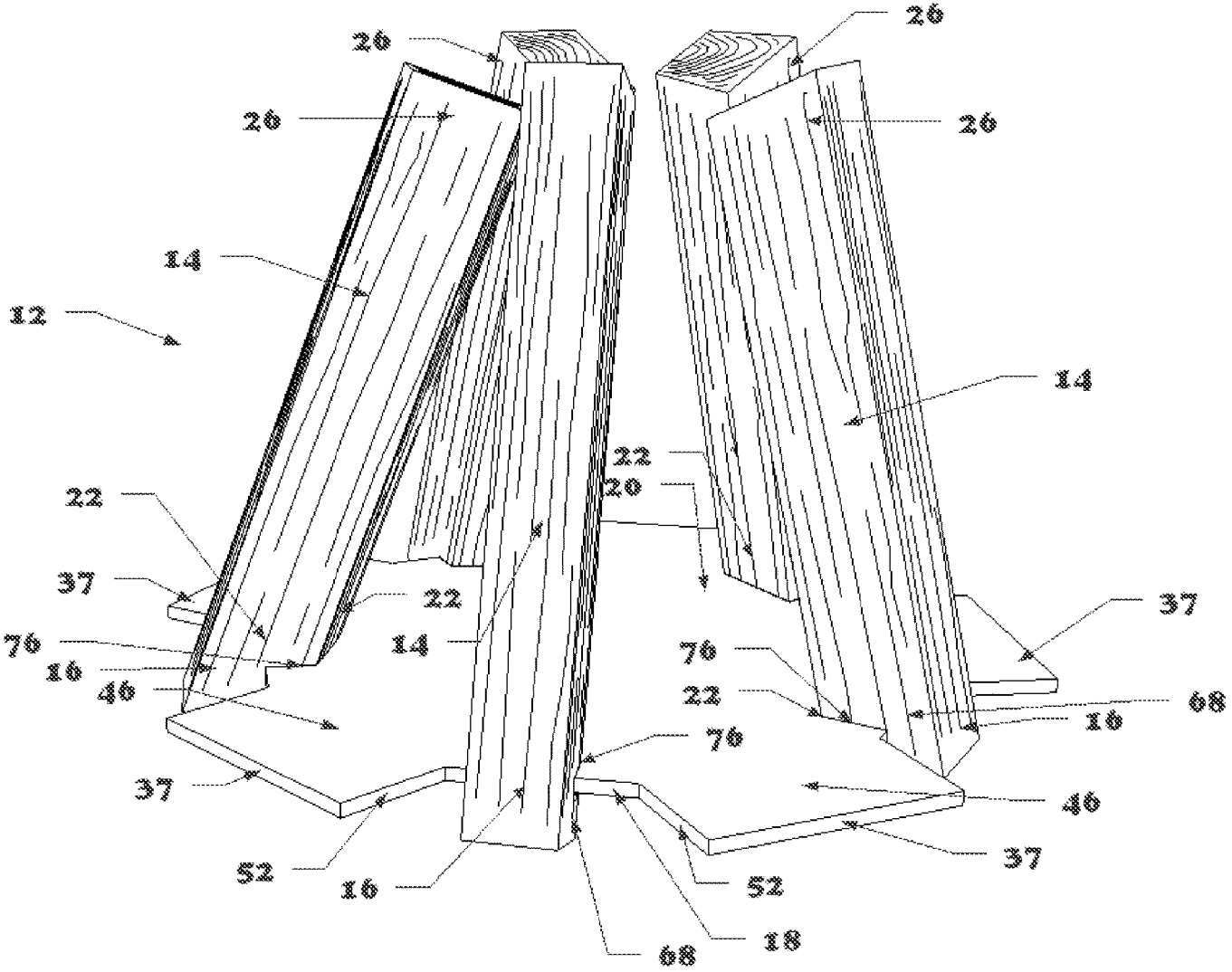
FIG. 5 is a front-top perspective view of an inner structure secured to a lower support member of the device of FIG. 1.
Figure 6:
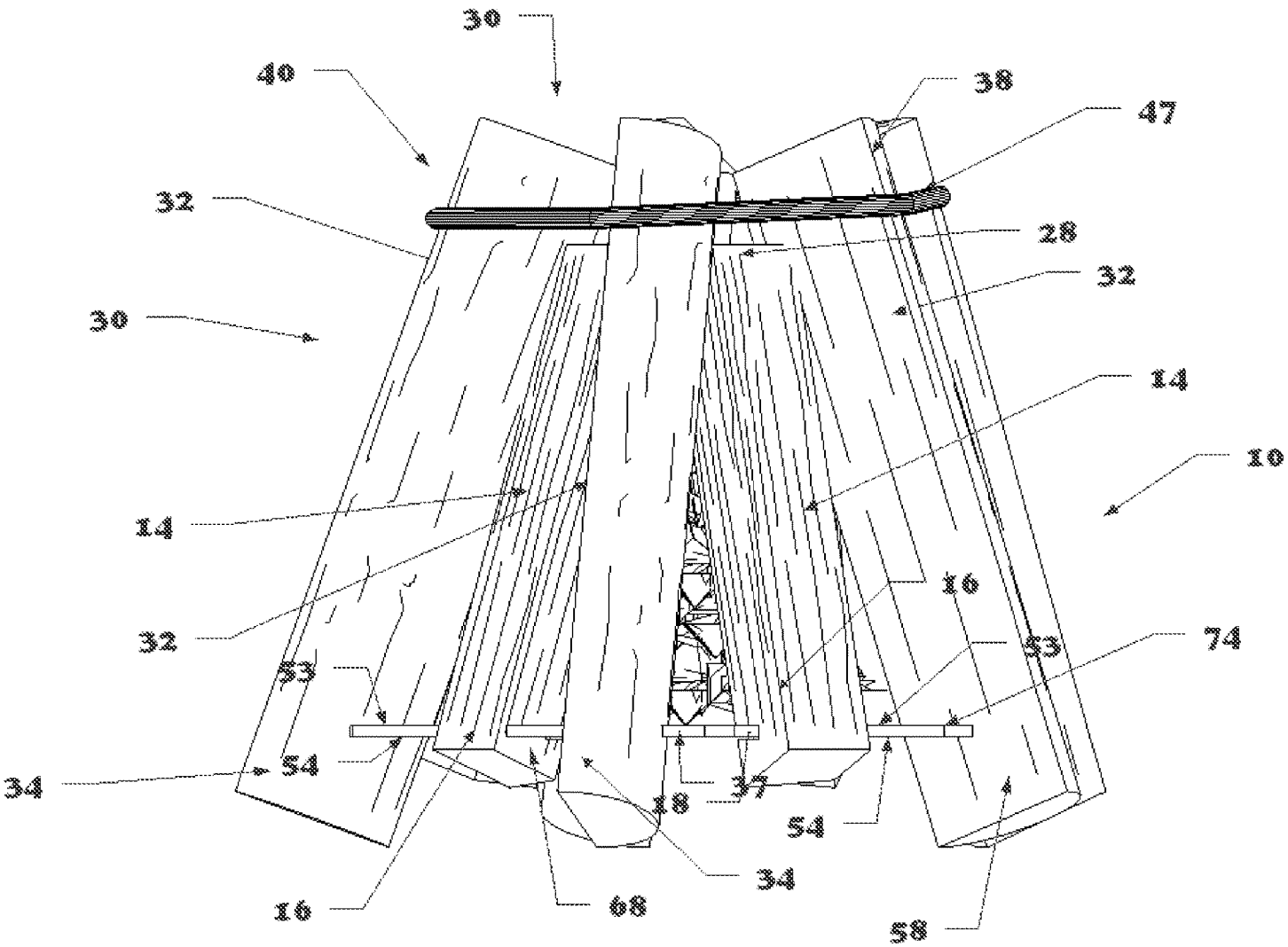
FIG. 6 is a front elevation view of the device of FIG. 1.
Figure 7:
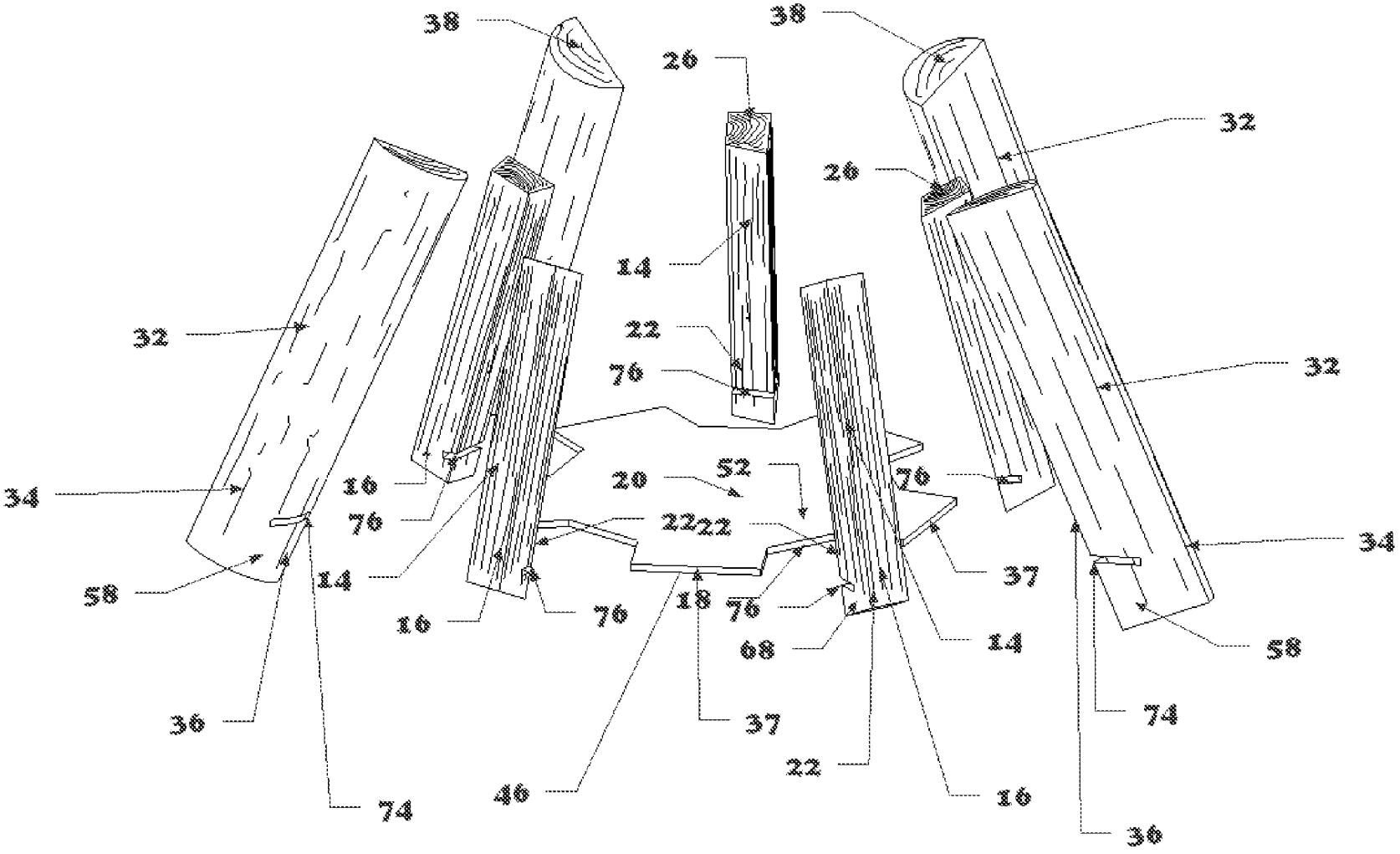
FIG. 7 is an exploded front perspective view of the device of FIG. 1, but without the inner paper fire accelerant.
Figure 8:
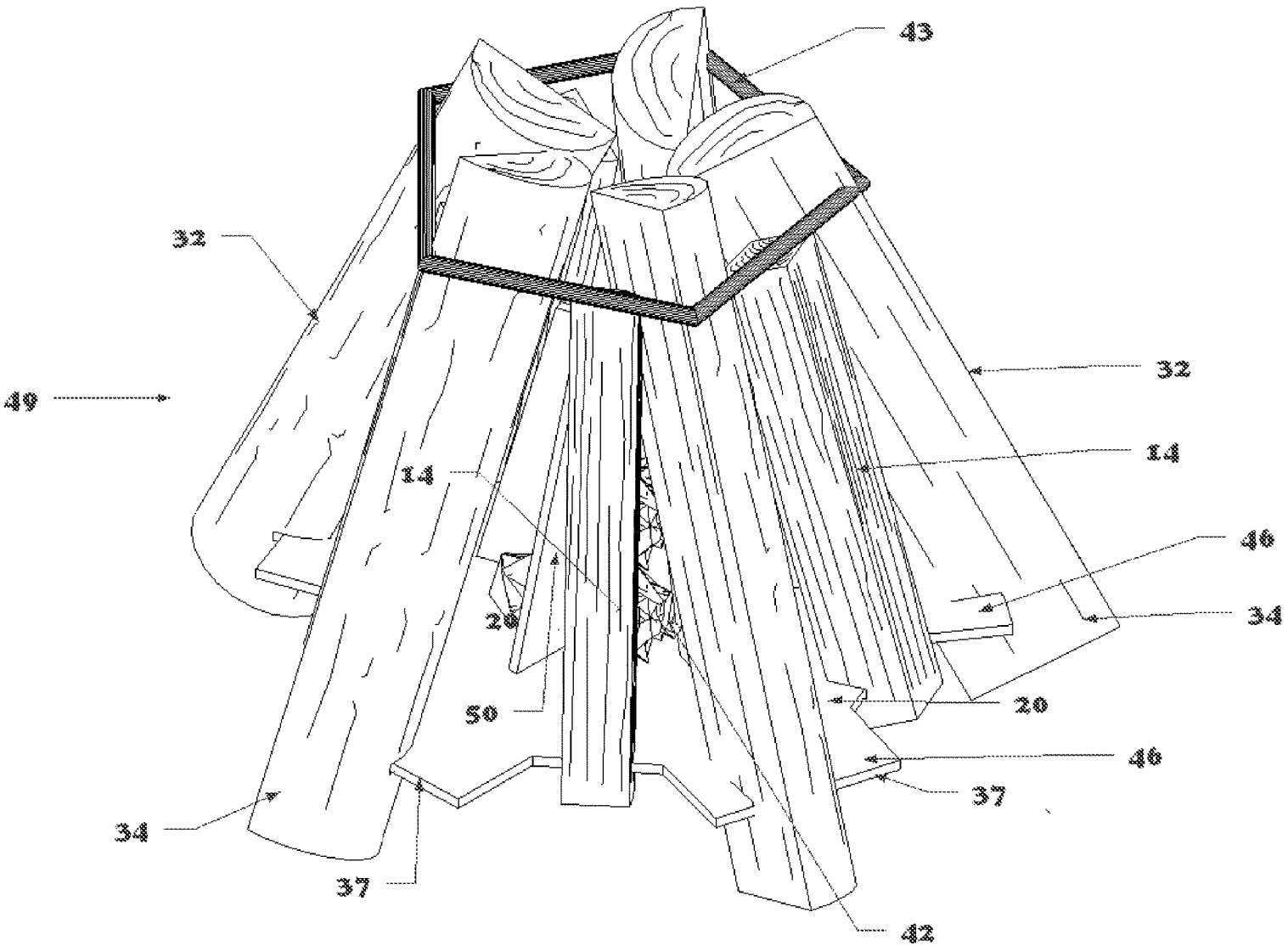
FIG. 8 is a front perspective view of an alternative construction of the device of FIG. 1 that includes the inner and outer combustible structures, but with a central combustible structure added and without the inner paper fire accelerant in accordance with the present invention.
Figure 9:
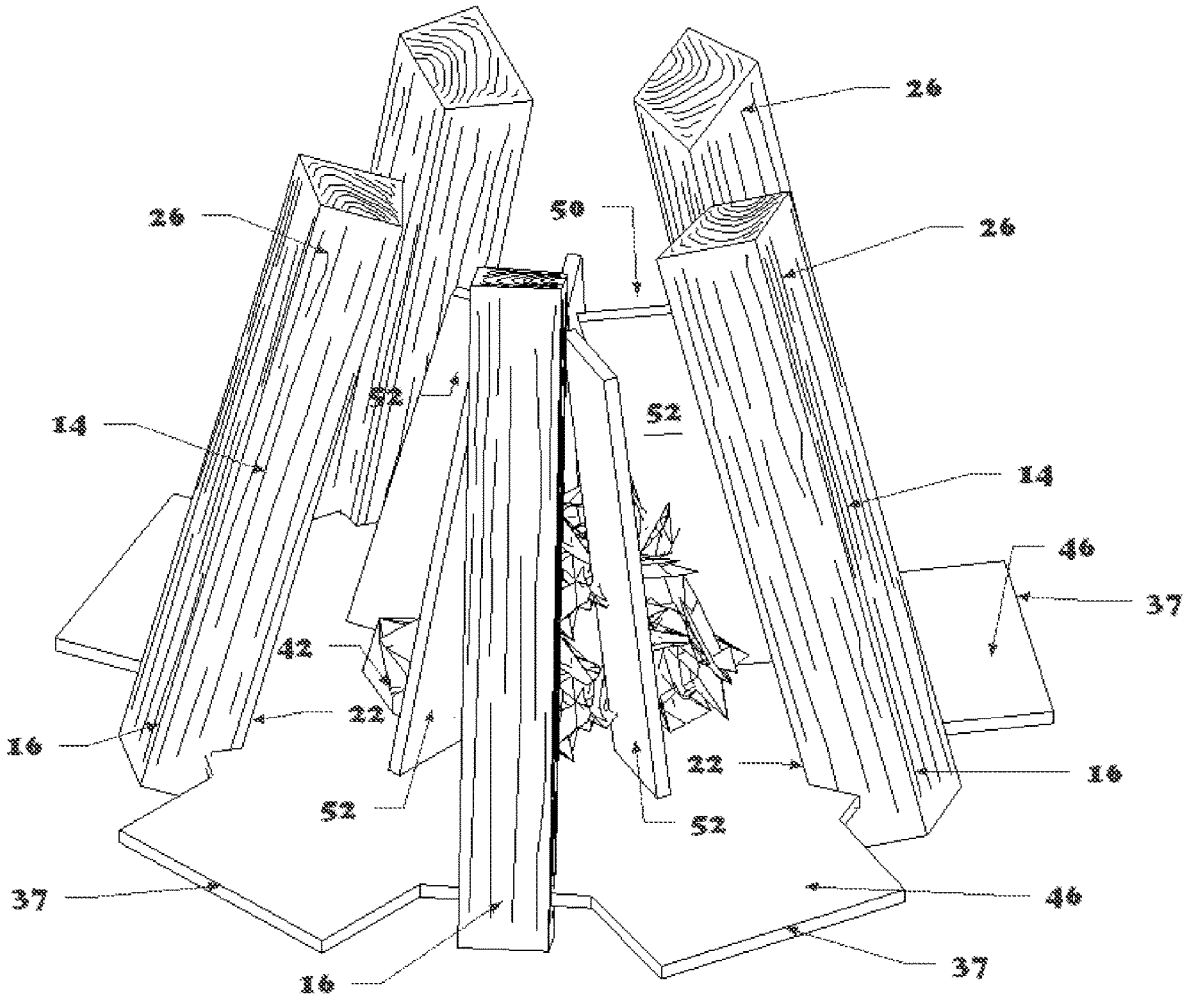
FIG. 9 is the front perspective view of the device of FIG. 8, but with the outer combustible structures removed and with an inner paper fire accelerant added.
Figure 10:
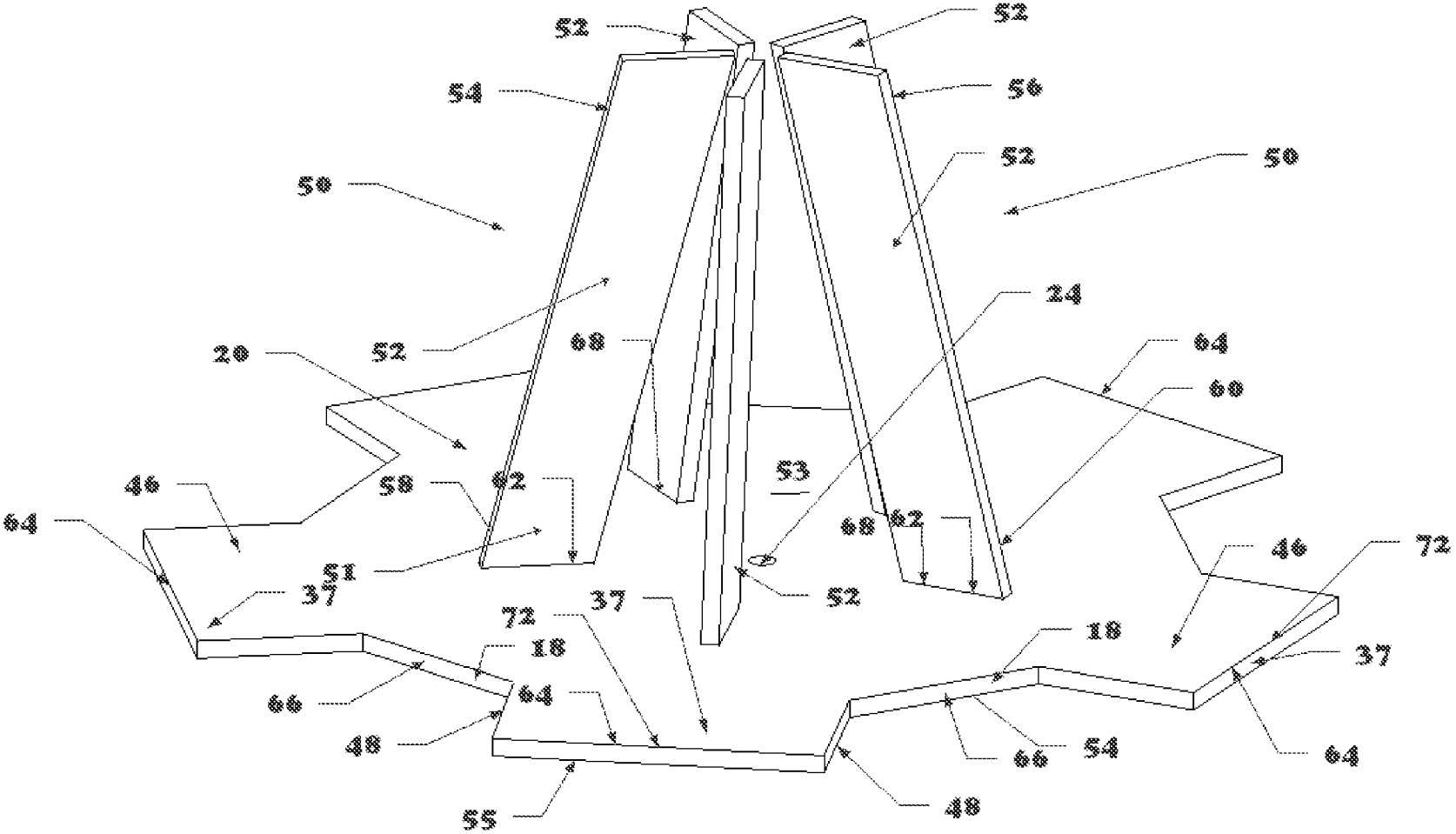
FIG. 10 is a front perspective view of only the central combustible structure and lower support member of the device of FIG. 8.
Figure 11:
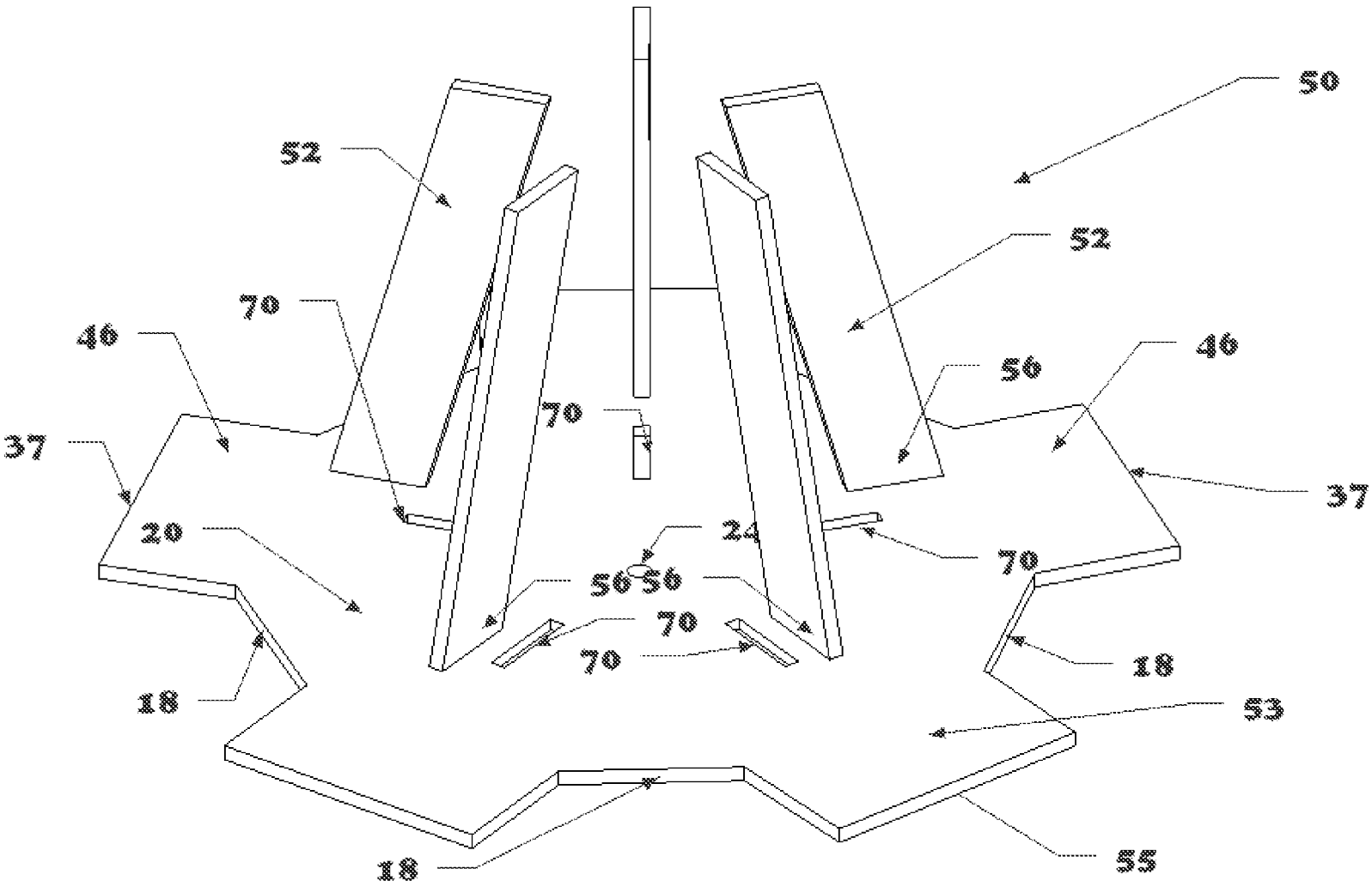
FIG. 11 is an exploded front perspective view of FIG. 10.
Figure 12:
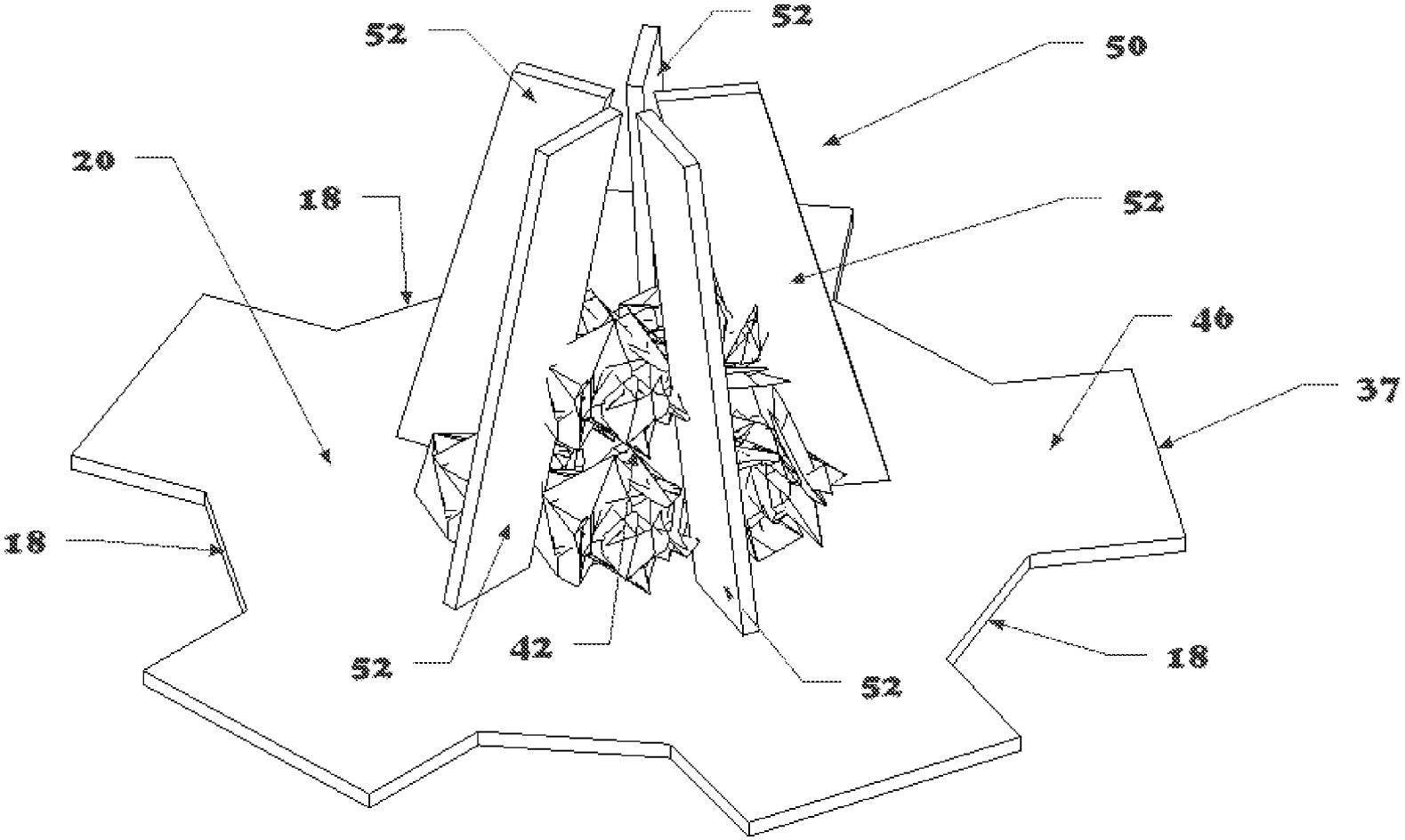
FIG. 12 is the front perspective view of FIG. 10, but with an inner paper fire accelerant added.
Figure 13:
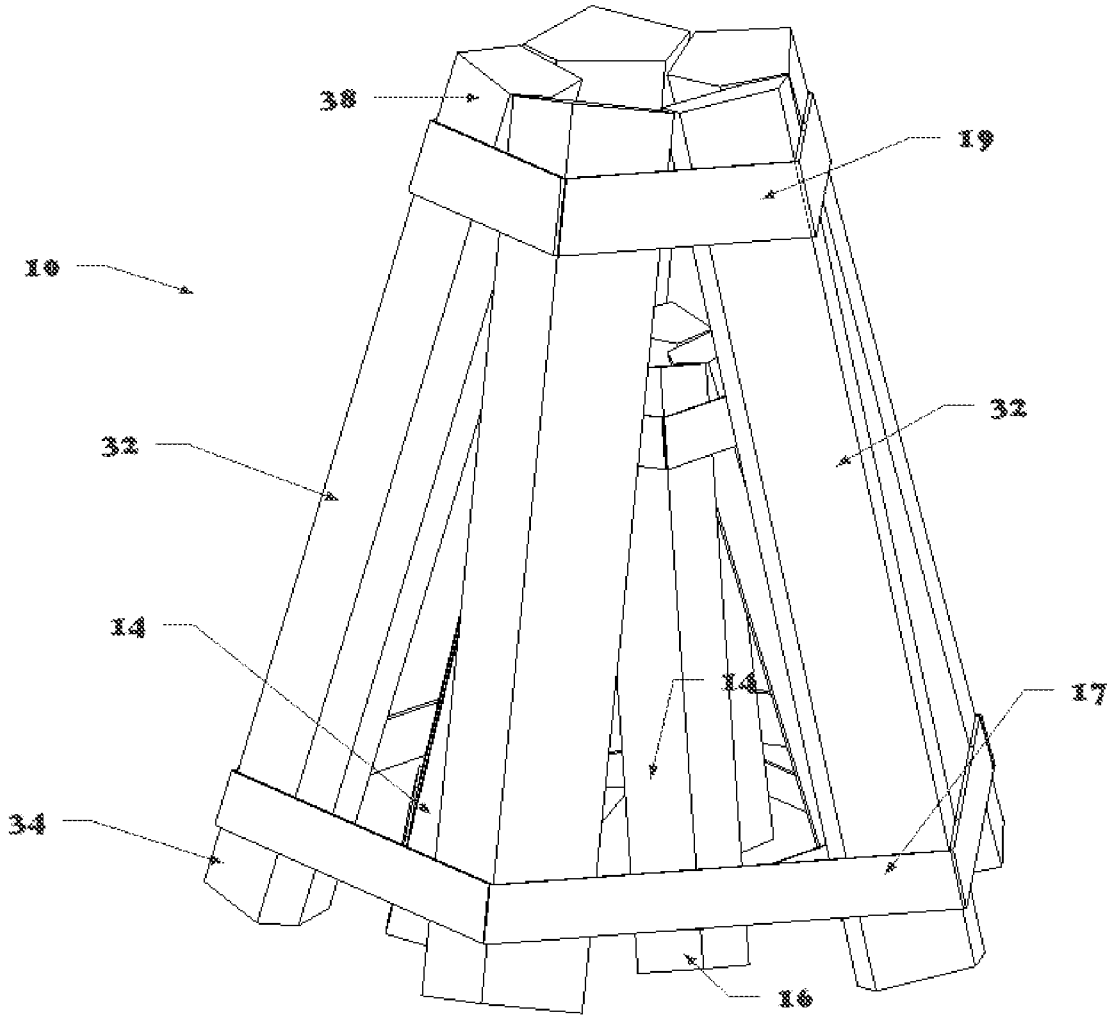
FIG. 13 is a front perspective view of an alternative construction of the device of FIG. 1 that depicts wooden boards for burning without including a lower support member for maintaining bottom end portions of the inner and outer combustible members in accordance with the present invention.
Figure 14:
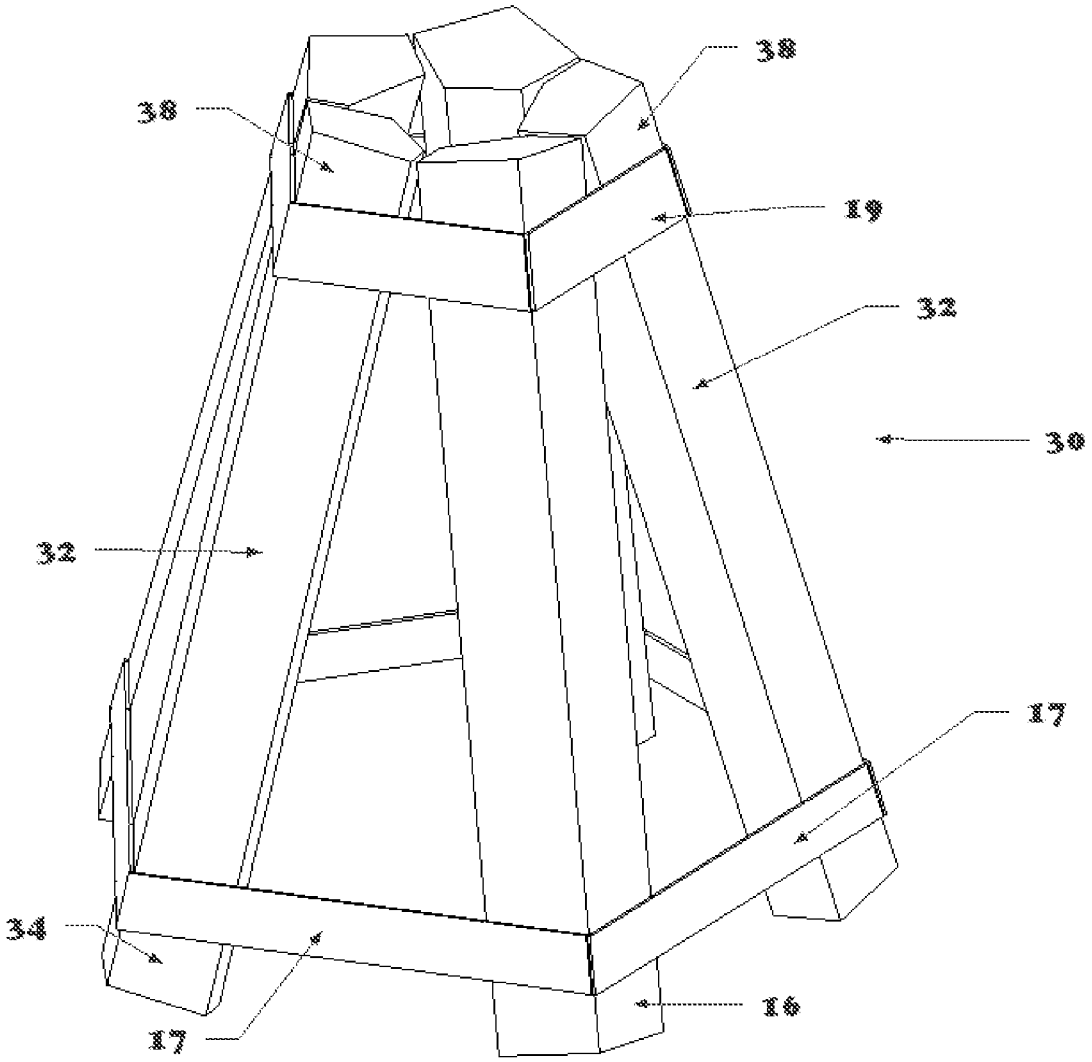
FIG. 14 is a front perspective view of the device of FIG. 13, but with the inner combustible members removed.
Figure 15:
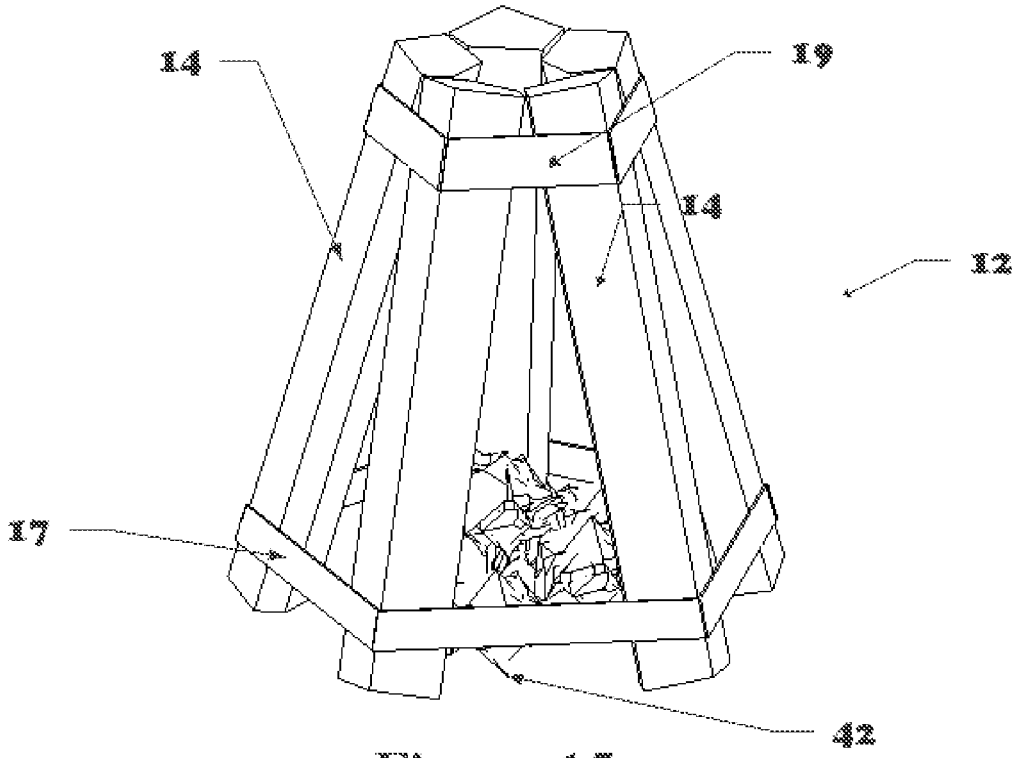
FIG. 15 is a front perspective view of the device of FIG. 13, but with the outer combustible members removed and a paper accelerant added inside the inner combustible structure formed via the inner combustible members.
Figure 16:
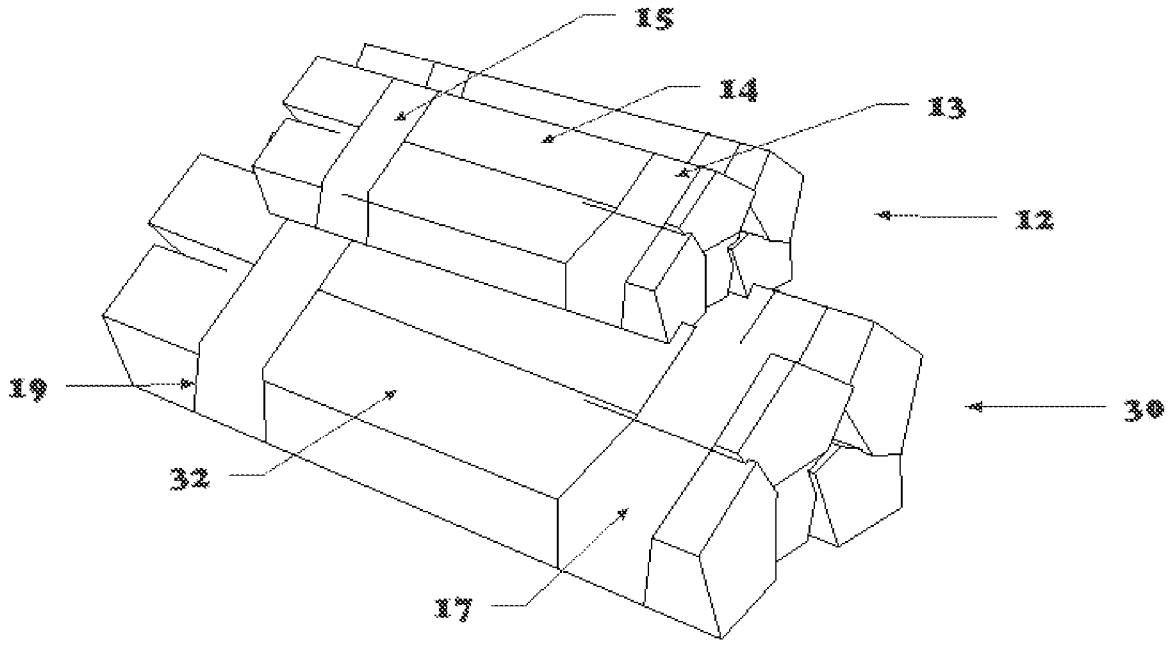
FIG. 16 is a perspective view of the inner and outer combustible members in collapsed positions for promoting the lifting and carrying of the inner and outer members by one person to a selected location to ultimately start and maintain a campfire.

Referring now to FIGS. 1-7, a device for starting and maintaining a campfire is denoted as number 10. The structure 10 includes an inner combustible structure 12 having a relatively frusto-conical configuration formed from a plurality of inner combustible members 14 having bottom end portions 16 separated and secured to inner edge portions 18 of a ten sided combustible lower support member 20, such that inner side portions 22 of the bottom end portions 16 of the inner combustible members 14 engage cooperating inner edge portions 18 of the lower support member 20. The plurality of inner combustible members 14 includes top end portions 26 proximately positioned such that a relatively frusto-conically configured top portion 28 formation results for the inner combustible structure 12. The depicted top end portions 26 are engagingly disposed but are generally not secured together; if the top portions 26 are required to be secured, a twine or string or wire (not depicted) can be used. The frusto-conical configuration of the inner structure 12 promotes faster starting campfire that provides more heat at ground level for the benefit of individuals seating around the campfire.

The campfire starting and maintaining device 10 further includes an outer combustible structure 30 substantially encasing the inner combustible structure 12. The outer structure 30 has a relatively frusto-conical configuration formed from a plurality of outer combustible members 32 having bottom end portions 34 separated and secured to the combustible lower support member 20 such that inner side portions 36 of the bottom end portions 34 of the outer combustible members 32 engage cooperating outer end edge portions 37 of extension members 46 of the lower support member 20. The plurality of outer combustible members 32 have top end portions 38 engagingly positioned such that a relatively frusto-conical configured top portion 40 is formed for the outer combustible structure 30. The inner and outer combustible structures cooperate such that the inner combustible structure 12 promotes the starting of a fire and the outer combustible structure 30 maintains the fire for a predetermined time range of substantially about two hours given the type and quantity of wood preferred by the inventor.

To promote the ignition of the inner combustible structure 12, a fire accelerant such as wax coated paper 42 is disposed inside the periphery of the inner combustible structure 12. The wax coating prevents moisture from impregnating the paper, thereby enabling a fire to ignite the wax paper 42 even in a rain or snow environment. When the wax paper 42 is ignited, the paper 42 promotes the ignition of the inner combustible structure 12, whereupon, the inner combustible structure 12 promotes the ignition of the outer combustible structure 30, which maintains a campfire for a predetermined time range depending on the amount and type of wood used to construct the outer combustible structure 30.

Although the device 10 is depicted with a lower support member 20, the device 10 can be modified such that the lower support member 20 is removed and only the inner and outer combustible structures 12 and 30 included, thereby requiring bottom end portions 16 and 34 for both the inner and outer combustible members 14 and 32 to be manually positioned upon a campfire ground surface. The inner and outer combustible structures 12 and 30 can be, but are not required to be secured together to promote the starting and maintaining of a campfire. To promote a minimum ignition time for the inner structure 12 to ignite the outer structure 30, the vertical centerlines (not depicted) of the inner and outer structures 12 and 30 should be axially aligned.

The device 10 without the lower support member 20 is assembled by placing a fire accelerant, such as waxed paper 42 on a selected camp fire area. The bottom end portions 16 of the inner members 14 are manually disposed upon the ground and circumferentially equidistant about the paper accelerant 42 such that the inner structure 12 forms a substantially frusto-conical configuration that encases the paper 42. The bottom end portions 34 of the outer members 32 are manually disposed upon the ground and circumferentially equidistant about the inner structure 12 such that the outer structure 30 forms a frusto-conical configuration that encases the inner structure 12. A campfire is started by a person igniting the waxed paper 42; whereupon, the waxed paper 42 ignites the inner combustible structure 12 relatively quickly. The burning inner structure 12 then relatively quickly ignites the outer combustible structure 30, which maintains a campfire for a predetermined time range.

Although the lower support member 20 is depicted in FIGS. 1-7 as having ten sides, the number of sides of the lower support member 20 can be increased or decreased to receive a corresponding number of inner and outer combustible members 14 and 32, thereby increasing or decreasing the size of the fire ultimately generated by a device 10. Further, the lower support member 20 can be modified to include larger dimensions with more or less sides to provide a campfire of a predetermined size and duration, resulting from the quantity and size of inner and outer combustible members 14 and 32 secured to the lower support member 20. More specifically, the greater the dimensions and number of sides for the lower support member 20, the larger the inner and outer members 14 and 32 that can be secured to the lower support member 20, and the larger the resulting campfire.

Referring now to FIGS. 8-12, an alternative device for starting and maintaining a campfire is denoted as numeral 49. The alternative device 49 includes the same lower support combustible structure 12, inner and outer combustible structures 12 and 30, securing rope 44, and fire accelerant 42 as the device 10 depicted in FIGS. 1-7. The alternative device 49 decreases the time to start a campfire by including a relatively smaller central combustible structure 50 formed from a plurality of central combustible members 52, thereby providing a central "teepee" structure 49 encased by the inner combustible structure 12, and both the central and inner teepee structures 49 and 12 being encased by the outer combustible structure 30. The central combustible structure 50 is fabricated from relatively thin sections of a fast burning type of wood such as lat strips used for receiving and supporting plaster or similar finishing compound.

The preferred dimensions for wood forming the central combustible structure 50 is substantially about eight inches longitudinally, two inches laterally and one-quarter of an inch thick. However, larger dimensions can be selected for central combustible structure 50 when larger inner and outer combustible structures 12 and 30 are used for starting and maintaining larger campfires. The central combustible structure 50 includes a relatively frusto-conical configuration having a top outer first side 54 to top outer second side 56 horizontal dimension of substantially about four inches; and a first bottom outer side 58 and second bottom outer side 60 each being disposed substantially about three inches from a center point 24 of the lower support member 20. Bottom lateral edges 62 of the central combustible members 52 are substantially lineally aligned with the center point 24 and midpoints 64 of respective outer end edge portions 37 of extension members 46.

The inner combustible members 14 are lineally aligned with the center point 24 of the lower support member 20 and midpoints 66 of respective inner edge portions 18. The outer combustible members 30 are lineally aligned with the center point 24 and midpoints 64 of respective end edge portions 37 of the extension members 46 of the lower support member 20. Bottom end planar lateral walls 68 that form the bottom lateral edges 62 of the central combustible members 52 are secured via an adhesive to the top planar wall 53 of the lower support member 20. Alternatively, rectangular apertures 70 (FIG. 11) through the lower support member 20 can be provided for snugly receiving the bottom walls 68 of the central combustible members 52 and an adhesive to better align and secure the central combustible members 52 to the lower support member 20.

The combustible lower support member 20 s fabricated from a relatively thin section of plywood substantially about one-quarter of an inch thick, which defines the distance separating the top planar wall 53 of the lower support member 20 from a bottom planar wall 55 of the lower support member 20. The lower support member 20 includes a ten sided polygon or decagon configuration having extension members 46 integrally joined to five alternating sides of the decagon configured lower support member 20, resulting in an extension member 46 disposed between two short sides 48 of the lower support member 20. The lower support member 20 further includes dimensions substantially about eight inches from an outer end edge portion 37 of a selected extension member 46 to the center point 24 of the lower support member 20.

The inner and outer combustible members 14 and 32 are generally inconsistently sized split logs, however, the outer members 32 are consistently larger than the inner combustible members 14, and the central combustible members are consistently smaller than the inner combustible members 14. The outer combustible members 32 include bottom inner end portions 58 secured to cooperating outer end edge portions 37 of the extension members 46 of the lower support member 20. The inner combustible members 14 include bottom extension side portions 68 secured to side edge portions 52 of extension members 46 of the lower support member 20 via slots 76 in the bottom extension side portions 68 of the inner combustible members 14. The slots 76 are dimensioned and configured to snugly receive without obstruction both the side edge portions 52 of the extension members 46 and the inner edge portions 18 of the lower support member 20. The slots 76 include an adhesive inserted in the slots 76 before inserting the side edge portions 52 of the extension members 46 and the inner edge portions 18 of the lower support member 20, thereby maintaining and stabilizing the position of the inner combustible members 14 relative to the lower support member 20 and outer members 32 without securing together the top end portions 26 of the inner members 14.

The bottom inner end portions 58 of the outer combustible members 32 include slots 74 for snugly receiving the outer end edge portions 37 of the extension members 46 of the lower support member 20. The slots 74 include an adhesive such as glue inserted in the slots 74 before inserting the extension member end edge portions 37 in the slots 74, thereby maintaining the position of the relatively large outer combustible members 32 relative to the lower support member 20. The top end portions 38 of the plurality of outer combustible members 32 are secured together by a rope or wire member 44 disposed around or inserted through apertures (not depicted) in the top end portions 38. The rope or wire member 44 is manually drawn tight such that the top end portions 38 are cooperatively engaged to form a relatively frusto-conical configured top portion 40 for the outer combustible structure 30. The rope or wire member 44 provides sufficient tensile strength to promote the manual lifting and carrying of the assembled inner and outer combustible structures 12 and 30 to a selected campfire location.

In operation, a person selects a campfire site, then carries a campfire starting device 10 or 49 to the site and disposed either device 10 and 49 on a cleared ground area to maintain fire safety. The person then ignites the waxed paper 42 and steps away from the device 10 a safe distance. The burning waxed paper 42 then ignites the central combustible structure 49 and/or the inner combustible structure 12 relatively quickly, whereupon the burning central and/or inner combustible structures 49 and 12 relatively quickly ignite the outer combustible structure 30, which maintains a campfire for a predetermined time range.

Referring to FIGS. 13-16, an alternative construction of the device 10 of FIG. 1 is depicted with wooden boards for burning without including a lower support member 20 for maintaining or otherwise fixing the positions of bottom end portions 16 and 34 of the inner and outer combustible members 14 and 32 in accordance with the present invention. Lower securing bands 17 have been included to secure together bottom end portions 16 and 34 of respective inner and outer combustible members 14 and 32; and upper securing bands 19 have been included to secure together top end portions 26 and 38 respective inner and outer combustible members 14 and 32. The lower and upper securing bands 17 and 19 cooperate with the inner and outer members 14 and 32 to form an outer combustible structure 30 that encases an inner combustible structure 12 that together, cooperate to quickly ignite then maintain a campfire for a predetermined time range. To further decrease the starting time for a campfire, a paper accelerant 42 is disposed inside the inner combustible structure 14 when the structure 14 is disposed with or without an encasing outer structure 30. The accelerant 42 can also be disposed inside an outer combustible structure 30 when used without encasing an inner structure 14.

To promote the lifting and carrying of the inner and outer structures 14 and 30 simultaneously by one person, the structures 14 and 30 are collapsed (FIG. 16), and the inner members 14 are engagingly secured together via securing bands 17 and 19, and the outer members 32 are engagingly secured together via securing bands 17 and 19, resulting in two sets of longitudinally aligned and secured members 14 and 32 that are relatively easy to carry and transport to a selected location to ultimately start and maintain a campfire. The securing bands 17 and 19 can be fabricated from a myriad of materials including but not limited to elastic materials, ropes and wire that have sufficient adjustable lengths to completely surround and secure the inner and outer members 14 and 32 to ultimately form inner and outer structures 12 and 30 that resemble encased "teepees," then allow the teepees to collapse and be longitudinally and independently secured via the variable length securing bands 17 and 19.

As an alternative to having assembled inner and outer combustible structures 12 and 30 joined together to ultimately provide a campfire, a structure for starting a campfire with firewood having varying lengths can be manually constructed at a campsite with firewood brought to or found at the campsite by disposing a plurality of inner combustible members 14 of varying or proximate lengths and configurations upon a ground surface such that top end portions 26 of the inner combustible members 14 are secured together, and bottom end portions 16 of the inner combustible members 14 are separated and engage cooperating ground portions (not depicted); and disposing a plurality of outer combustible members 32 of varying or proximate lengths and configurations about the plurality of inner combustible members 14.

The outer combustible members 32 are relatively longer than the inner combustible members 14, thereby enabling top end portions 38 of the outer combustible members 32 to be secured together and above secured together top end portions 26 of the inner combustible members 32 when bottom end portions 34 of the outer combustible members 32 engage cooperating ground portions (not depicted) about the bottom end portions 16 of the inner combustible members 14. The inner and outer combustible members 14 and 32 cooperate such that the inner combustible members 14 promote the starting of a fire and the outer combustible members 32 maintain the fire for a predetermined time range.

The invention claimed is:

1. A device for starting and maintaining a campfire comprising:

an inner combustible structure having a relatively frusto-conical configuration formed from a plurality of inner combustible members having bottom end portions distally separated from adjacent bottom end portions of adjacent inner combustible members, said bottom end portions of said inner combustible members being secured to respective inner portions of a combustible lower support member such that outer bottom end portions of said inner combustible members are substantially equidistant from a center point of said combustible lower support member, said combustible lower support member includes a ten-sided decagon configuration having extension members integrally joined to five alternating sides of said decagon configured lower support member, resulting in an extension member disposed between and thereby separating two adjacent inner combustible members, said plurality of inner combustible members having top end portions secured together such that a relatively frusto-conically configured top portion is formed for said relatively frusto-conically configured inner combustible structure; and an outer combustible structure substantially encasing said inner combustible structure, said outer combustible structure having a relatively frusto-conical configuration formed from a plurality of outer combustible members having bottom end portions distally separated from adjacent bottom end portions of adjacent outer combustible members, said bottom end portions of said outer combustible members being secured to respective outer portions of said lower support member such that outer bottom end portions of said outer combustible members are substantially equidistant from said center point of said lower support member, said plurality of outer combustible members having top end portions secured together such that a relatively frusto-conically configured top portion is formed for said relatively frusto-conically configured outer combustible structure; whereby, said inner and outer combustible structures cooperate such that said inner combustible structure promotes the starting of a fire and said outer combustible structure maintains the fire for a predetermined time range.

2. The device of claim 1 wherein said inner combustible structure includes a fire accelerant disposed inside the periphery of said inner combustible structure, said fire accelerant promoting the ignition of said inner combustible structure when said fire accelerant is ignited.

3. The device of claim 2 wherein said fire accelerant is fabricated from paper.

4. The device of claim 3 wherein said paper fire accelerant is covered with wax to prevent moisture from impregnating said paper fire accelerant.

5. The device of claim 2 wherein said inner combustible structure is fabricated from relatively thin sections of wood.

6. The device of claim 1 wherein said frusto-conically configured inner combustible structure includes a top dimension of substantially about four inches separating outer top end portions of substantially opposing top end portions of opposing inner combustible members when said substantially opposing top end portions are secured together.

7. The device of claim 6 wherein said frusto-conically configured inner combustible structure includes said outer bottom end portions of said inner combustible members being separated from said center point of said lower support member substantially about three inches.

8. A device for starting and maintaining a campfire comprising:

an inner combustible structure having a relatively frusto-conical configuration formed from a plurality of inner combustible members having bottom end portions distally separated from adjacent bottom end portions of adjacent inner combustible members, said bottom end portions of said inner combustible members being secured to respective inner portions of a lower support member such that outer bottom end portions of said inner combustible members are substantially equidistant from a center point of said lower support member, said lower support member including a configuration having multiple sides with extension members integrally joined to alternating sides of said lower support member, resulting in an extension member disposed between and thereby separating two adjacent inner combustible members, said plurality of inner combustible members having top end portions that engage adjacent top end portions of said inner combustible members to form a relatively frusto-conically configured top portion for said relatively frusto-conically configured inner combustible structure; and an outer combustible structure substantially encasing said inner combustible structure, said outer combustible structure having a relatively frusto-conical configuration formed from a plurality of outer combustible members having bottom end portions distally separated from adjacent bottom end portions of adjacent outer combustible members via corresponding adjacent extension members, said bottom end portions of said outer combustible members being secured to respective outer portions of said lower support member such that outer bottom end portions of said outer combustible members are substantially equidistant from said center point of said lower support member, said outer bottom end portions of said outer combustible members being separated from said bottom end portions of said inner combustible members a distance corresponding to the configuration and dimensions of said extension members integrally joined to said lower support member, said plurality of outer combustible members having top end portions secured together such that a relatively frusto-conically configured top portion is formed for said relatively frusto-conically configured outer combustible structure; whereby, said inner and outer combustible structures, and said extension members integrally joined to said lower support member cooperate to maintain a space between said inner and outer combustible structures for increasing air flow through said device, resulting in said inner combustible structure promoting the starting of a fire and said outer combustible structure maintaining the fire for a predetermined time range.

9. The device of claim 8 wherein said outer combustible members are relatively large when compared to said inner combustible members, thereby allowing said outer combustible members to substantially encase said inner combustible members.

10. The device of claim 8 wherein said outer combustible members include bottom inner end portions secured to cooperating end edge portions of said extension members of said lower support member.

11. The device of claim 10 wherein said outer combustible members include bottom side end portions secured to cooperating side edge portions of said extension members of said lower support member.

12. The device of claim 8 wherein said inner combustible members include bottom inner end portions secured to cooperating inner edge portions of short sides of said lower support member.

13. The device of claim 10 wherein said bottom inner end portions of said outer combustible members secured to cooperating end edge portions of said extension members of said lower support member include said bottom end portions having slots for snugly receiving said end edge portions of said extension members of said lower support member, said slots including an adhesive inserted therein before inserting said extension member end edge portions, thereby maintaining the position of said outer combustible members relative to said lower support member.

14. The device of claim 8 wherein said inner combustible structure includes a disc member secured to each of said top end portions of said inner combustible members, thereby maintaining separation between said combustible members and maintaining said frusto-conical configuration of said inner combustible structure, thereby promoting a faster starting campfire and that provides more heat at ground level to individuals seated around the campfire.

15. The device of claim 8 wherein said plurality of outer combustible members having top end portions secured together such that a frusto-conical configured top portion is formed for said frusto-conically configured outer combustible structure includes a rope member inserted through apertures in said top end portions to receive said rope member, thereby snugly securing together said top end portions of said outer combustible members when said rope member is manually drawing tight such that said top end portions cooperatively engaged, and enabling a person to lift and carry said assembled inner and outer combustible structures via said rope member.

16. A structure for starting a campfire comprising:

a plurality of inner combustible members having top end portions of said inner combustible members that engage adjacent top end portions of said inner combustible members, and bottom end portions of said inner combustible members separated and secured to respective inner portions of a lower support member such that outer bottom end portions of said inner combustible members are substantially equidistant from a center point of said lower support member, said lower support member including a configuration having multiple sides with extension members integrally joined to alternating sides of said lower support member, resulting in an extension member disposed between and thereby separating two adjacent inner combustible members; and a plurality of outer combustible members disposed about said plurality of inner combustible members, said outer combustible members being relatively longer than said inner combustible members, thereby enabling top end portions of said outer combustible members to be secured together and above top end portions of said inner combustible members when bottom end portions of said outer combustible members are secured to said extension members integrally joined to alternating sides of said lower support member, said bottom end portions of said outer combustible members being separated from said bottom end portions of said inner combustible members a distance corresponding to the configuration and dimensions of said extension members integrally joined to said lower support member; whereby, said inner and outer combustible members, and said extension members integrally joined to said lower support member cooperate to maintain a space between said inner and outer combustible structures for increasing air flow through said device, resulting in said inner combustible members promoting the starting of a fire and said outer combustible members maintaining the fire for a predetermined time range.

17. The structure of claim 16 wherein said plurality of inner combustible members includes a fire accelerant disposed inside the periphery of said inner combustible members, said fire accelerant promoting the ignition of said inner combustible members when said fire accelerant is ignited.

* * * * *